US005406482A

United States Patent [19]

McCoy et al.

[11] Patent Number: 5,406,482

[45] Date of Patent: Apr. 11, 1995

[54] METHOD AND APPARATUS FOR MEASURING PUMPING ROD POSITION AND OTHER ASPECTS OF A PUMPING SYSTEM BY USE OF AN ACCELEROMETER

[75] Inventors: James N. McCoy, 2210 Midwestern Parkway, Wichita Falls, Tex. 76308; Jerry B. West, Dallas; Augusto L. Podio, Austin, both of Tex.

[73] Assignee: James N. McCoy, Wichita Falls, Tex.

[21] Appl. No.: 808,578

[22] Filed: Dec. 17, 1991

[51] Int. Cl.[6] ..... G06F 15/00; E21B 47/00

[52] U.S. Cl. ..... 364/422; 73/151

[58] Field of Search ..... 364/422; 73/151, 151.5

[56] References Cited

U.S. PATENT DOCUMENTS

| | | | |
|---|---|---|---|
| 4,047,430 | 9/1977 | Angehrn | 73/151 |
| 4,064,763 | 12/1977 | Srinivasan | 73/516 R |
| 4,213,740 | 7/1980 | Chien | 417/63 |
| 4,561,299 | 12/1985 | Orlando et al. | 73/151 |
| 4,662,209 | 5/1987 | Brown | 73/1 D |
| 4,674,571 | 6/1987 | Vogen | 166/249 |
| 4,797,822 | 1/1989 | Peters | 364/422 |
| 4,968,934 | 11/1990 | Robinet et al. | 324/207.22 |
| 5,019,978 | 5/1991 | Howard, Jr. et al. | 364/422 |
| 5,182,946 | 2/1993 | Boughner et al. | 73/151 |

*Primary Examiner*—Gail O. Hayes
*Assistant Examiner*—A. Bodendorf
*Attorney, Agent, or Firm*—Richards, Medlock & Andrews

[57] ABSTRACT

An oil well pumping unit has a walking beam which raises and lowers a rod connected to a downhole pump. To perform well analysis, it is desirable to know the position of the rod during the stroke. An accelerometer is mounted on the pumping system unit to move in conjunction with the rod. An output signal from the accelerometer is digitized and provided to a portable computer. The computer processes the digitized accelerometer signal to integrate it to first produce a velocity data set and second produce a position data set. Operations are carried out to modify the signal and produce a position trace with stroke markers to indicate positions of the rod during its cyclical operation.

12 Claims, 5 Drawing Sheets

METHOD AND APPARATUS FOR MEASURING PUMPING ROD POSITION AND OTHER ASPECTS OF A PUMPING SYSTEM BY USE OF AN ACCELEROMETER

FIELD OF THE INVENTION

The present invention pertains, in general, to instrumentation for oil field equipment and in particular to the determination of pumping rod position and other physical aspects for a reciprocating pumping system.

BACKGROUND OF THE INVENTION

In most oil wells, the pumping is carried out by use of a reciprocating downhole pump that is supported by a pumping rod which extends from the pump to the earth's surface where it is connected to a reciprocating walking beam. The beam is provided with a counter balance weight to offset the weight of the rod, the pump and the fluid column. There are many variable factors involved in the operation for pumping equipment of this type. Various types of instrumentation have been developed to monitor the pumping operation and measure the parameters of such operation. Once such measurements have been made, it is often possible to make adjustments and optimizations to improve the pumping efficiency of the well. For some measurements it is necessary to know the position of the rod in the stroke of the pumping operation. This measurement has heretofore been made in a number of ways. One technique has been to use a spring-loaded rotating potentiometer connected to the rod or beam by a string or cable so that the potentiometer rotates with the up and down motion of the rod or walking beam. This produces a changing resistance that is proportional to the position of the rod. However, mechanical equipment of this type is awkward, expensive and subject to easy breakage. The position of the rod can also be determined by mechanical position switches, but these are also subject to wear, environmental damage and calibration difficulties.

An apparatus for measuring the position of a suckerrod is described in U.S. Pat. No. 4,561,299 entitled "Apparatus for Detecting Changes in Inclination or Acceleration".

An apparatus which utilizes an accelerometer to measure course length in a wellbore is described in U.S. Pat. No. 4,662,209 entitled "Course Length Measurement". This device, however, does not measure pump rod position.

Thus, there exists a need for a method and a corresponding apparatus for determining the position of a pumping rod and to analyze other pumping system aspects during pumping operations in such a manner that is reliable, accurate, inexpensive, convenient and not significantly affected by wear and exposure.

SUMMARY OF THE INVENTION

The present invention, in one embodiment, is directed to a method and apparatus for determining the position of a rod used in a reciprocating pumping system wherein the rod extends downward into a borehole in the earth and is joined to a downhole pump which lifts fluid within the borehole to the surface of the earth. An accelerometer is mounted on the pumping system to move in conjunction with the rod. An output signal is generated from the accelerometer. This output signal is provided to a digitizer which translates the analog output signal of the accelerometer into a first set of digital samples. The first set of digital samples is integrated to produce a second set of digital samples. The second set of digital samples are then integrated to produce a third set of digital samples, which essentially correspond to positions of the rod in its reciprocating motion.

In another aspect of the present invention, the third set of digital samples are normalized to a predetermined actual rod stroke to correct the determined rod stroke so that it corresponds to the true rod stroke. The determined rod stroke could be inaccurate due to errors in accelerometer calibration or sensitivity drift due to temperature or other variable factors.

In another aspect of the present invention, an accelerometer is calibrated by measuring the output signal in a first upright position and sequentially in a second inverted position. These two output signals are then combined to produce a calibration factor for the accelerometer.

In a still further aspect of the present invention, the output from an accelerometer mounted on a pumping system is displayed on the screen of a computer to indicate operation of the pumping system, including any anomalies in the operation such as unusual vibrations or pounding.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figures 1, 2:
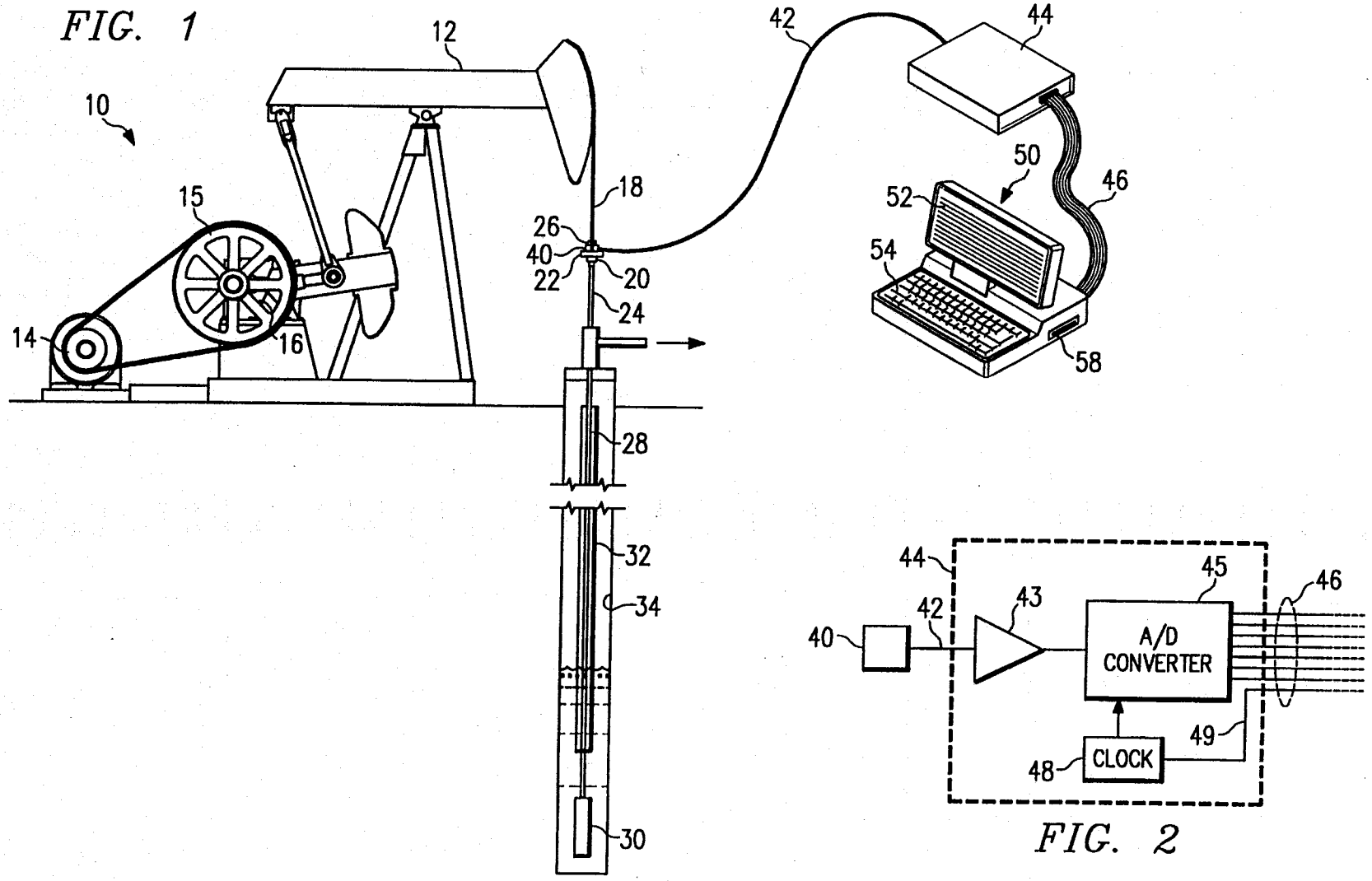
FIG. 1 is a perspective view of a reciprocating pumping system which raises and lowers a rod connected to a downhole pump in a cyclical motion to lift fluid from within a borehole in the earth to the surface, an accelerometer is mounted on the polished rod, and electronic equipment is provided for processing the signal from the accelerometer to indicate rod position.
FIG. 2 is a schematic circuit illustration of the electronic components which connect the accelerometer to a computer.

The present invention and its application is illustrated in FIG. 1. A pumping system includes a walking beam 12 that is driven by a motor 14 through a belt and pulley assembly 15 and gearbox 16. The beam 12 is connected by cables 18, which are secured by cable clamps 20 to a carrier bar 22. A polished rod 24 is secured by a rod clamp 26 to the carrier bar 22. A polished rod 24 is connected to a sucker rod 28 that extends downward in the borehole and is connected to a downhole pump 30. The rod 28 is positioned within tubing 32 and casing 34. An accelerometer 40 is mounted between the rod clamp 26 and the carrier bar 22. However, it could be mounted at any position where movement corresponds to motion of the polished rod 24.

In operation, the motor 14 drives the beam 12 in an up and down, reciprocating, fashion which in turn raises and lowers the rods 24 and 28 so that the pump 30 lifts fluid through the tubing 32 upward to the surface.

The accelerometer 40 is mounted on the polished rod 24 and connected through a electrical cable 42 to an electronics package 44. The output from the package 44 is connected through a ribbon cable 46 to a computer 50 that includes a screen 52, keyboard 54 and a disk drive 58.

The accelerometer 40 uses a sensor which is preferably a model 3021 manufactured by IC Sensors, a company located in Milpitas, Calif. This is a piezoresistive accelerometer. It preferably has a range of $\pm 2$ g or $\pm 5$ g.

Figures 3, 8:
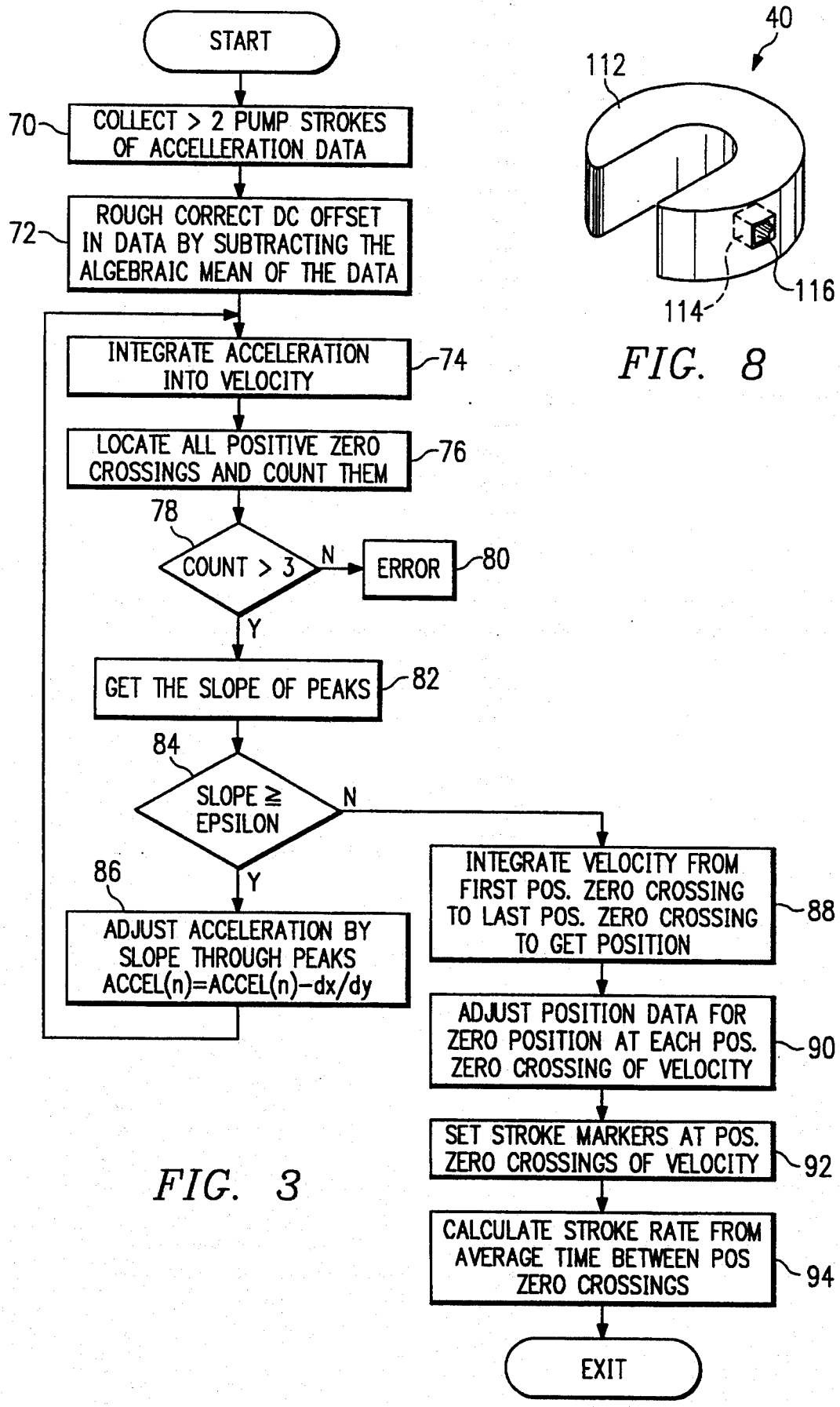
FIG. 3 is a flow diagram indicating the processing operations carried out for the accelerometer signal within the computer.
FIG. 8 is a perspective illustration of an accelerometer mount which includes an accelerometer sensor.

The accelerometer 40 is shown in greater detail in FIG. 8. This device has a U-shape with an open slot such that the accelerometer 40 can be inserted onto the rod 24 without the need to remove the rod clamp 26. Accelerometer 40 includes a high-strength steel body 112 which has an opening for receiving an accelerometer sensor 114 and is provided with an electrical socket 116 for receiving the cable 42. The sensor 114 is the model 3021 noted above. Accelerometer 40 can be inserted on the rod 12 with either side up. The accelerometer 40, or just the accelerometer sensor 114 can be affixed to the rod 24 in any manner, including merely clamping it to the rod. The body 112 can further comprise or include a load cell for measuring the load on the rod 24. Such load information can be measured concurrently with the acceleration information.

Referring to FIG. 2, the electronics package 44 includes an amplifier 43 which receives the output signal of the accelerometer 40 through cable 42. The output from the amplifier 43 is provided to an analog-to-digital (A/D) converter 45 which produces digital samples corresponding to the output signal from the accelerometer 40 and transmits these digital samples through the ribbon cable 46 to the computer 50.

The electronics package 44 further includes a clock 48 which provides clock signals to the analog-to-digital converter and to the computer 50 through a line 49 in the cable 46. The clock 48 provides a 1000 Hz clock signal to the converter 45 so that it takes samples of the accelerometer signal at 1 millisecond intervals. The clock 48 further produces a signal every 50 milliseconds which is transmitted through line 49 and produces an interrupt at the computer 50. The computer 50 accepts a sample of the accelerometer signal upon receipt of each interrupt. Therefore, the computer 50 receives samples of the accelerometer signal at 50 millisecond intervals.

The computer 50 is preferably a Toshiba Model 1000SE. The processing of the output signal from the accelerometer 40 is described in FIG. 3.

Figure 4A:
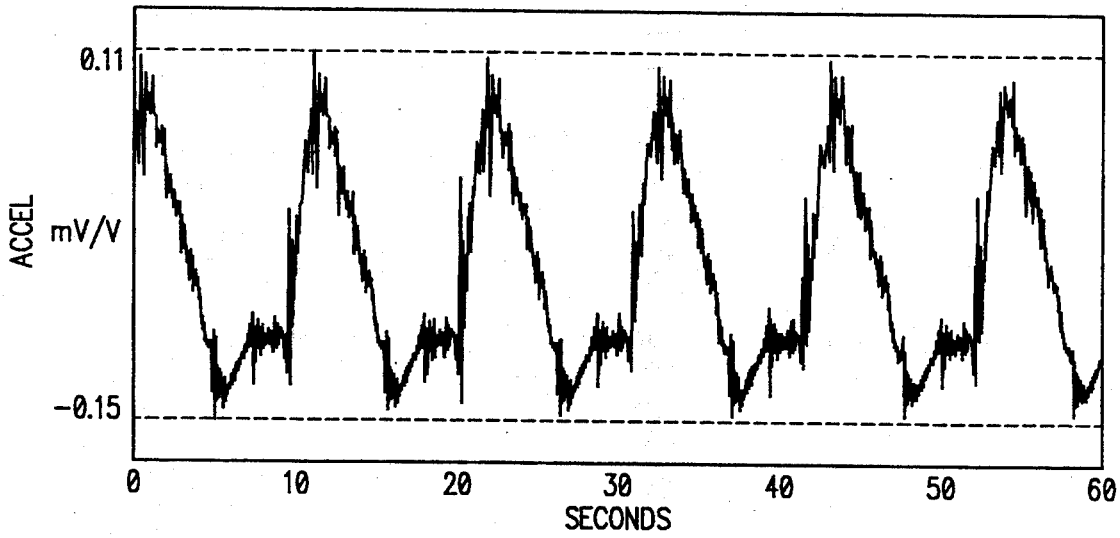
FIGS. 4A–4D are waveforms illustrating the accelerometer output signal in 4A, the DC offset corrected accelerometer signal in 4B, the first integrated signal (velocity) in 4C, and the second integrated signal (position) along with stroke markers in 4D.
Figure 4B:
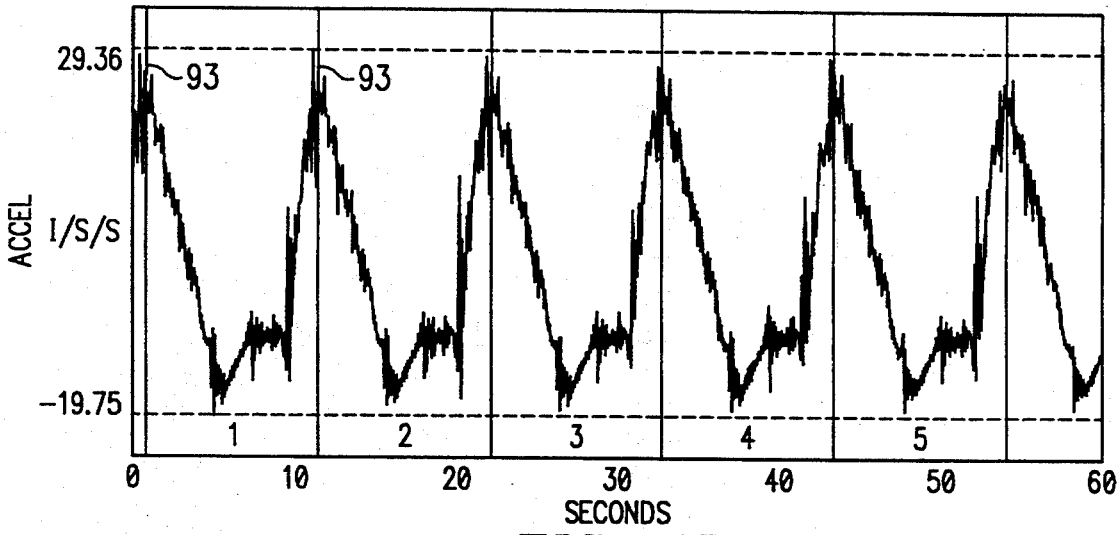
Figure 4C:
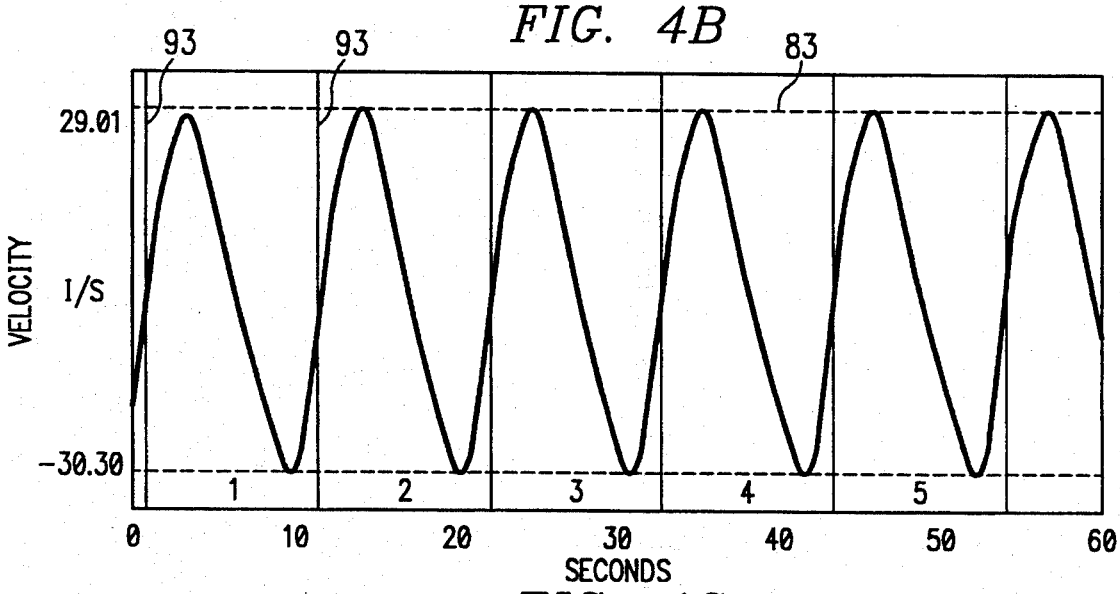
Figure 4D:
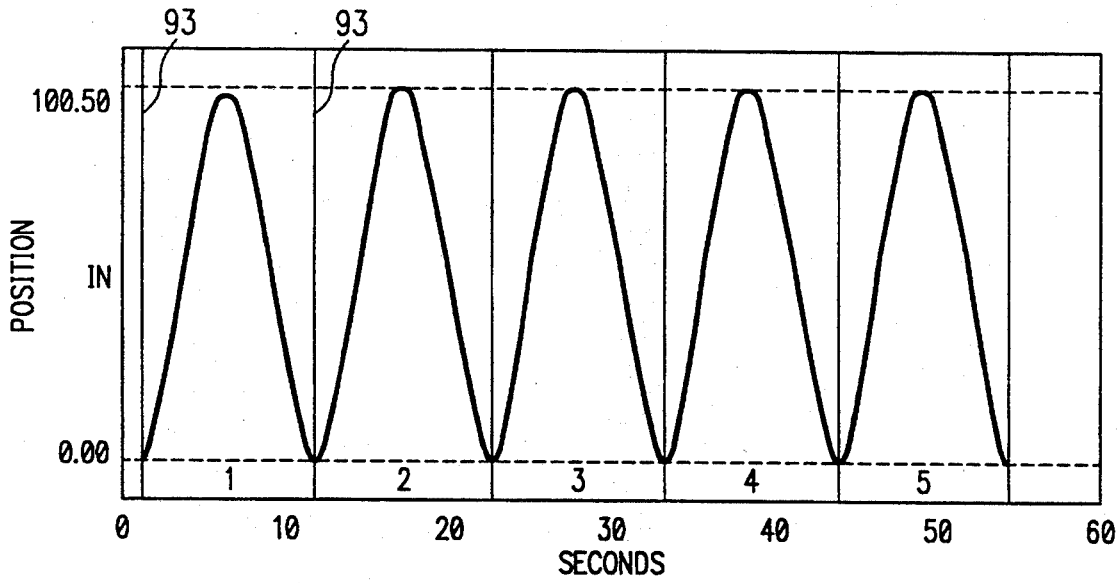

The operation of the computer 50 with the output signal of the accelerometer 40 for a selected embodiment is described as a series of operational steps in FIGS. 3, 4A–4D and 6. Various waveforms are illustrated in FIGS. 4A–4D. FIG. 4A shows the analog output signal of the accelerometer and the vertical scale is in millivolts per volt. In FIG. 4B, the accelerometer output signal is illustrated with a vertical scale in inches per second per second. In FIG. 4C, there is shown a velocity waveform with a vertical scale in inches per second. In FIG. 4D, there is shown a waveform for rod position with the vertical scale in inches.

Accelerometer 40 generates a varying output depending on the state of acceleration it experiences. This analog electrical signal is provided through the cable 42, amplified and converted to digital samples within the electronics package 44. The digital samples are then provided through the cable 46 to the computer 50. Within the computer 50, the steps described in FIG. 3 are carried out. In step 70, data is received for a time sufficient to ensure that at least two complete pump strokes (cycles) of acceleration data are collected. The analog accelerometer output signal is illustrated in FIG. 4A. This data has five cycles in a period of time just over 50 seconds. In step 72 the algebraic mean of the accelerometer signal shown in FIG. 4A is subtracted from the signal itself to substantially correct for DC offset in the signal. The acceleration information portion of the accelerometer output signal can be relatively small compared to the DC offset. If this DC offset is not removed, integration of the signal to produce velocity will generate a steep ramp in which the cyclic information is obscured. This is due to integrating a constant. The subtraction of the algebraic mean removes this constant of integration. The digitized and DC corrected accelerometer output signal is illustrated in FIG. 4B as a function of time.

In step 74, the digital signals corresponding to the output of the accelerometer, as shown in FIG. 4B, are integrated to produce a second set of digital signals which essentially correspond to rod velocity. The set of integrated samples (second set of digital samples) for pump rod velocity are illustrated as a waveform in FIG. 4C.

In step 76, all positive zero crossings are detected and counted. Next, in step 78 a determination is made if the count of positive going zero crossings exceeds three. If not, an error message is generated by operation in step 80. If the count exceeds three, entry is made to step 82 wherein the slope of the peaks within the signal is determined.

Following step 82, entry is made into step 84 for determination if the slope determined in step 82 equals or exceeds a predetermined value termed epsilon. A dotted line 83 intersects the peaks of the waveform. An illustration of the velocity signal with the line 83 is further shown in FIG. 6. In this FIGURE the integration from the signals shown in FIG. 4B includes a constant of integration which causes the waveform to be progressively increasing. This constant must be removed so that the waveform has a zero slope of the peaks, as shown in FIG. 4C. If the slope is greater than or equal to epsilon, entry is made to step 86 in which the acceleration data produced in step 72 is adjusted by the formula ACCEL(n)=ACCEL(n)−dx/dy. A preferred value for epsilon is 0.01%. The value dx/dy is a measure of the slope of the peaks, i.e. the slope of line 83. In step 86, the value of dx/dy, in incremental steps, is subtracted from each of the data points shown in the acceleration waveform in FIG. 4B until the value of dx/dy, the slope of the dotted line 83, is less than epsilon. After each adjustment to the acceleration signal shown in FIG. 4B, that signal is integrated to produce the signal shown in FIG. 4C wherein the slope of line 83 is again determined. This process is repeated until the slope of the peaks become less than epsilon.

If the slope value determined is not greater than or equal to epsilon, entry is made through the negative exit to step 88 in which the second set of digital samples are integrated between the first positive zero crossing and the last positive zero crossing. This produces essentially a position signal for the pump rod. See FIG. 4D.

Following step 88, step 90 is performed to adjust the position data for zero position at each positive zero crossing for the second set of digital values, which set represents velocity.

In step 92, following step 90, stroke markers 93 are set at positive zero crossings for the velocity signal set of data. The stroke markers 93 are also applied at the determined times to the broad position waveform shown in FIG. 4D and the acceleration waveform shown in FIG. 4B. The adjusted position data with stroke markers is shown in FIG. 4D. After step 92, step 94 is carried out to calculate the stroke rate from the average time between positive zero crossings. The processing of this signal enters an exit after the completion of step 94.

The signal shown in FIG. 4A has the vertical axis labeled in millivolts per volt. The signal produced at the output of the accelerometer 40 is an electrical signal which is typically measured in millivolts. The value indicated in FIG. 4A is produced by dividing the actual accelerometer output signal by the amplitude of the power supply voltage. This produces a signal which is independent of variations in the supply voltage provided to the system.

Acceleration, velocity and position data for the polished rod can be used in a variety of ways to measure and evaluate the performance of the pumping system. The load on a polished rod during the pumping cycle is normally acquired in conjunction with the polished rod position. Such load information can be acquired by use of a load cell such as that disclosed in U.S. Pat. No. 4,932,253 issued Jun. 12, 1990 to McCoy. The torque on a pumping unit gear box can be determined if there is a knowledge of the polished rod load, as well as the polished rod position. A thorough analysis of the pumping system requires a knowledge of polished rod load and position to verify that the surface equipment is operating properly and that the rod string is properly loaded. Further, recent mathematical treatments of load and/or position/velocity allow the calculation of downhole pump loadings. This is described in a publication by Gibbs, S. G., "Predicting the Behavior of Sucker Rod Pumping Systems", J. Pet. Tech. (July 1963) 769–778; Trans., AIME, 228. A downhole pump card, produced as described in the article, is illustrated in FIG. 5B. The information disclosed in this figure further helps to determine pump performance, including standing valve, traveling valve and pump plunger operation. The first integration of acceleration produces velocity, which is used in the determination of the downhole pump loading, as shown in FIG. 5B.

The waveforms shown in FIGS. 4A–4D, 5A and 5B are displayed on the display screen 52 of the computer 50, shown in FIG. 1. This allows the operator to see the signals which have been collected, and those which have been processed.

In a prior technique, the load on a polished rod was acquired and displayed as a function of the polished rod position. This used mechanical test equipment in which the display of polished rod load versus polished rod position was produced by rotating a drum on which the load was scribed. To produce a display, such as shown in FIG. 5A, the load on the rod and the position of the rod must both be known.

Figure 5A:
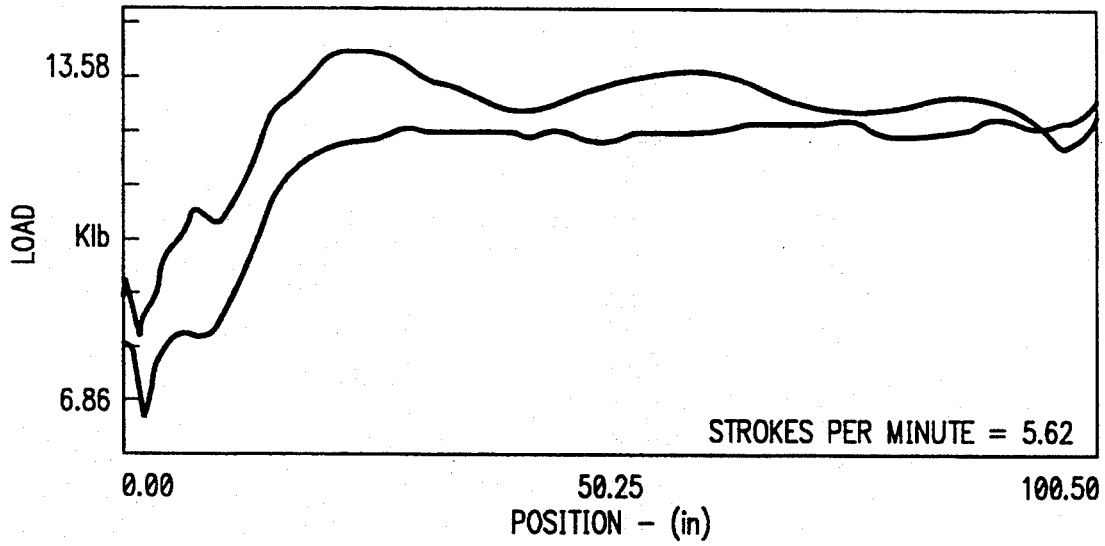
FIG. 5A is a surface card illustration for load on a pumping rod versus position as shown by conditions at the surface.
Figure 5B:
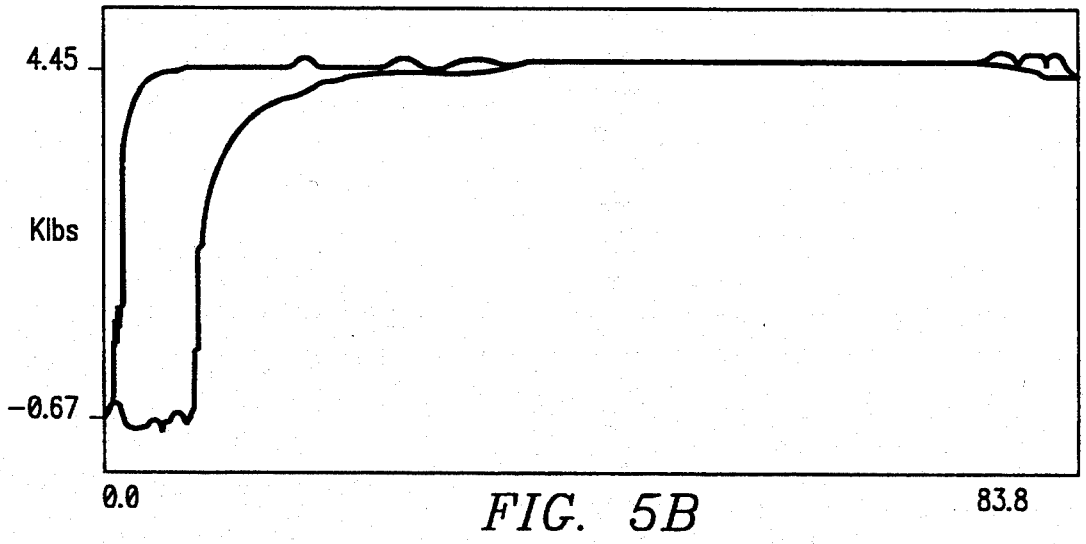
FIG. 5B is a downhole card illustration for load on the pump versus position as calculated for the downhole pump location.
Figure 6:
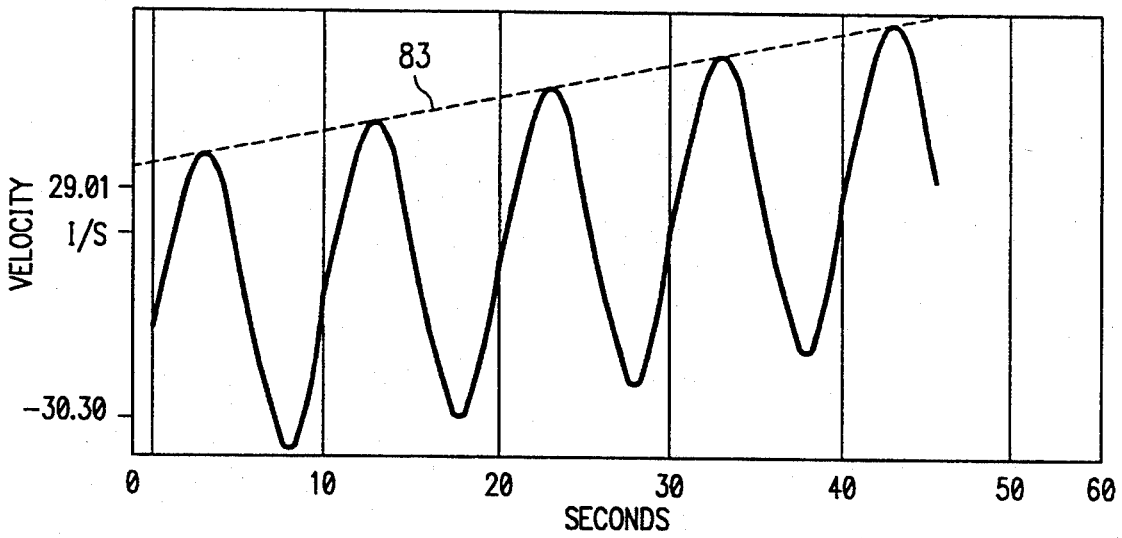
FIG. 6 is an illustration of integration to produce a velocity signal, such as shown in FIG. 4C, but with a constant of integration producing an upward sloping waveform with time.

Referring now to FIGS. 5A and 5B, there are illustrated respectively a surface card and a downhole card each measuring rod load versus rod position. The information in FIG. 5A can be produced by measuring rod load (vertical scale) through use of commonly available load cells. The position information (horizontal scale) can be that produced in accordance with the present invention as set forth in FIG. 4D. The utilization of this information to produce the downhole card shown in FIG. 5B is described in the article by Gibbs noted above.

One objective of the present system is to acquire acceleration data from an oil well pumping system during the pumping cycle for the purpose of determining polished rod position. The accuracy of the calculated polished rod position depends upon the accuracy of the accelerometer sensitivity factor, also referred to as a calibration factor. The sensitivity of the accelerometer varies with temperature. In field installations, the accelerometer is not always installed in exact alignment with the axis of the polished rod. This results in variation of the accelerometer data. Further, the gravitational field of the earth varies from one location to another. In a further aspect of the present invention, an actual measurement of the accelerometer sensitivity factor is performed at the well location in the field and the sensitivity factor is calculated for the system being used by performing the following steps. The accelerometer 40, see FIG. 8, is placed in an upright position on the polished rod, as shown in FIG. 1, and the output signal is measured while the pumping unit is stopped. Next, the accelerometer 40 is removed and then replaced in an inverted position. The output signal from the accelerometer 40 is again measured while the pumping unit is stopped. In both the upright and inverted cases, the output of the accelerometer is transmitted through cable 42 to the electronics package 44 where the signal is digitized and then transferred through cable 46 to the computer 50. The output of the accelerometer is a dc signal measured in millivolts. The first measurement produces a reference value with +1 g applied acceleration and the second value measured is for −1 g applied acceleration. The difference in the signal outputs represents the sensitivity of the accelerometer 40 to a 2 g field. This is a highly accurate method of measuring the accelerometer sensitivity while at the same time automatically compensating for all of the variables pertaining to the pumping system and the location. It further calibrates the accelerometer to the particular electronics being utilized, as well as to the effects of temperature, gravitational field and any other factors affecting the accelerometer 40 output.

As an example of the above calibration procedure, the first output of the accelerometer can be, for example, +10 millivolts for the +1 g field and −10 millivolts for a −1 g field (inverted). This is a 20 millivolt difference for a 2 g gravity difference, which results in a calibration factor of 10 millivolts per g. (20 millivolts÷2 g=10 mv/g) This calibration factor is used to produce the data shown in FIG. 4B from that shown in FIG. 4A.

The accelerometer 40, as shown, is physically removed to invert its position to produce the calibration factor. However, the accelerometer sensor can also be clamped to the rod 24, or an element having corresponding motion, such that the accelerometer sensor can be rotated in place in an inverted position. This reduces the effort need to remove the accelerometer and then replace it on the polished rod.

Further procedure for making the calibration constant is to utilize a value normalized for the supply voltage, as described above for the signal shown in FIG. 4A. Using the above example for calibration, assuming an 8.0 volt supply voltage, the +1 g calibration signal would be 1.25 millivolts/volt and the −1 g field calibration signal would be −1.25 millivolts/volt. This would result in a calibration factor of 1.25 millivolts/volt per g. This calibration factor can be used directly to multiply the data in FIG. 4A to produce the data in FIG. 4B.

Figure 7A:
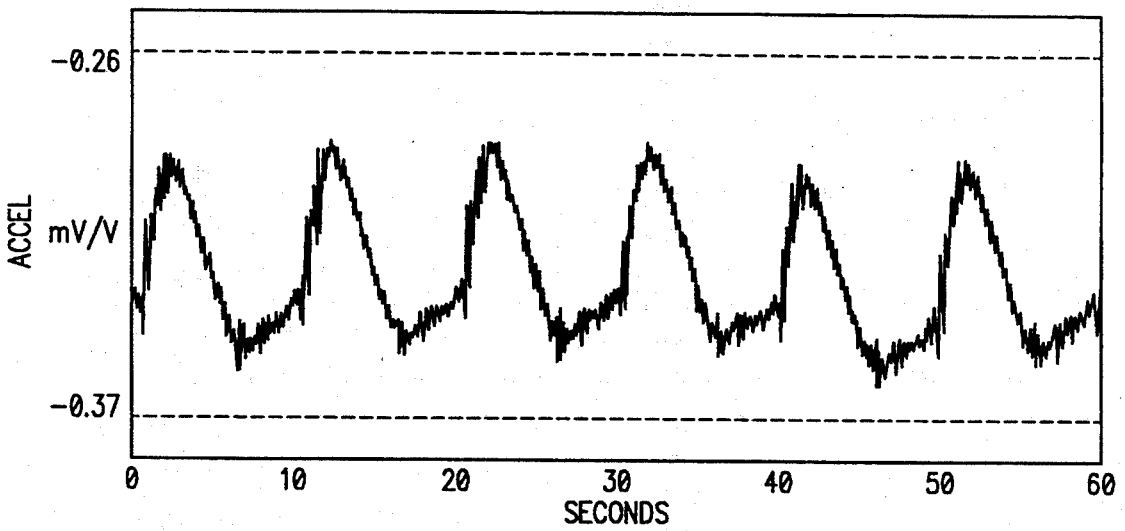
FIG. 7A is an accelerometer output waveform produced on a screen display showing normal operation of a pumping system and FIG. 7B is an accelerometer output waveform displayed on a screen which indicates abnormal vibrations and therefore abnormal operation of a pumping system.
Figure 7B:
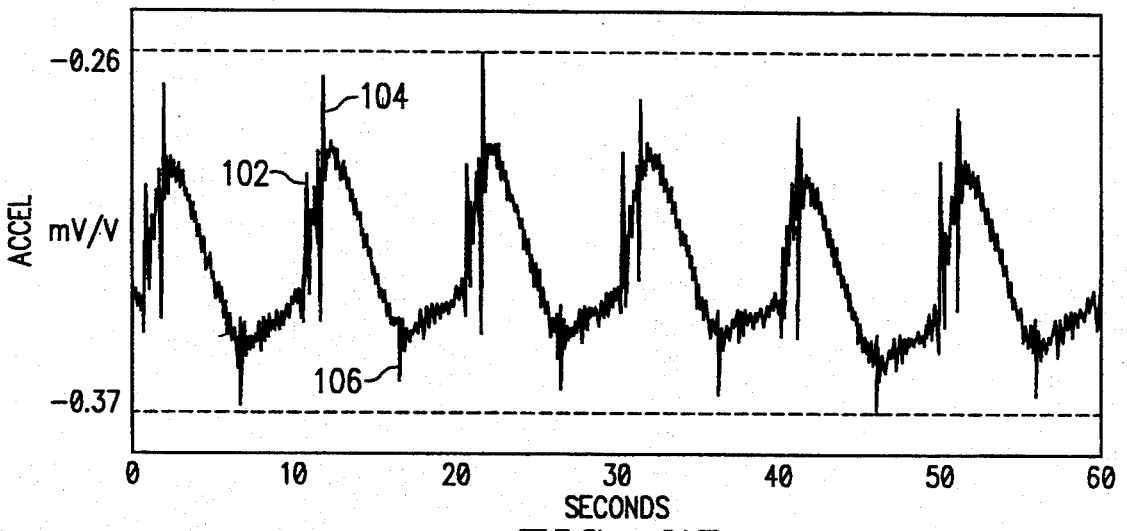

A still further aspect of the present invention is the utilization of an accelerometer for the observation of pumping system performance as illustrated in FIGS. 7A and 7B. FIG. 7A represents the output signal from the accelerometer 40 for a pumping system, such as shown in FIG. 1, in which the operation is normal. This is indicated by the generally smooth acceleration curve. FIG. 7B is the output signal from the accelerometer 40 for the same or similar pumping unit, but with improper operation. The signal in FIG. 7B includes abnormal vibrations indicated by the lines 102, 104 and 106. These abnormal vibrations are essentially repeated in each of the cycles of the signal. Such vibrations can be generated by defective gear teeth, worn bearings, abnormal surface conditions, unit misalignment, abnormal downhole pump conditions, and downhole mechanical problems. These large acceleration spikes (lines 102, 104 and 106) in the acceleration signal indicate that severe shock loads occur at these times. FIGS. 7A and 7B are displayed concurrently on the screen 52 of the computer 50 so the abnormalities can be readily determined. The signal in FIG. 7A can be recorded at a time when it is known that the pumping system is working well or it can be a representative signal for a pumping unit of the particular type which is to be examined.

Although one embodiment of the invention has been illustrated in the accompanying drawings and described in the foregoing detailed description, it will be understood that the invention is not limited to the embodiment disclosed, but is capable of numerous rearrangements, modifications and substitutions without departing from the scope of the invention.

What we claim is:

1. A method for measuring the position of a rod connected to a reciprocating pumping system wherein the rod extends downward into a borehole in the earth and is joined to a downhole pump which lifts fluid from within the borehole to the surface of the earth, comprising the steps of:

generating an output signal from an accelerometer mounted to said reciprocating pumping system, recording a plurality of cycles of said output signal to produce a first signal, integrating said first signal to produce a second signal which has a substantially zero average value, determining times of occurrences for zero crossover points in said second signal, integrating said second signal to produce a third signal, and applying said times of occurrences to said third signal to designate stroke extremities for said rod and whereby said third signal corresponds to the position of said rod.

2. A method for measuring the position of a rod as recited in claim 1 including the step of scaling the amplitude said third signal such that the peak-to-peak amplitude of said third signal corresponds to a predetermined stroke length for said rod.

3. A method for measuring the position of a rod as recited in claim 1 further including the step of displaying on a computer screen one or more waveforms corresponding to either said first signal, said second signal or said third signal.

4. A method for measuring the position of a rod connected to a reciprocating pumping system wherein the rod extends downward into a borehole in the earth and is joined to a pump which lifts fluid from within the borehole to the surface of the earth, the method comprising the steps of:

generating an output signal from an accelerometer mounted to said reciprocating pumping system, recording a plurality of cycles of said output signal to produce a first signal, processing, including integrating, said first signal to produce a second signal in which the maximum or minimum amplitudes of each cycle are set to have essentially the same value, and processing, including integrating, said second signal to produce a third signal in which the maximum or minimum amplitudes of each cycle are set to have essentially the same value, and wherein said third signal corresponds to positions of said rod.

5. A method for measuring the position of a rod as recited in claim 4 including the step of scaling the amplitude of said third signal such that the peak-to-peak amplitude of said third signal corresponds to a predetermined stroke length for said rod.

6. A method for measuring the position of a rod as recited in claim 4 including the step of selecting at least two reference points in said third signal to correspond respectively to predetermined positions of said rod.

7. A method for measuring the position of a rod as recited in claim 4 further including the step of displaying on a computer screen one or more waveforms corresponding to either said first signal, said second signal, or said third signal.

8. A method for measuring the position of a rod connected to a reciprocating pumping system wherein the rod extends downward into a borehole in the earth and is joined to a pump which lifts fluid from within the borehole to the surface of the earth, comprising the steps of:

generating an output signal from an accelerometer mounted to said reciprocating pumping system, recording a plurality of cycles of said output signal to produce a first signal, determining the algebraic mean of said first signal, correcting offset in said first signal by subtracting therefrom said algebraic mean of said first signal, integrating said offset corrected first signal to produce a second signal, detecting at least a first and a later second zero crossing of said second signal, each said zero crossing have a given transition polarity, and integrating said second signal from said first zero crossing to said second zero crossing to produce a third signal which corresponds to positions of said rod.

9. A method for measuring the position of a rod as recited in claim 8 including the step of scaling the amplitude of said third signal such that the peak-to-peak amplitude of said third signal corresponds to a predetermined stroke length for said rod.

10. A method for measuring the position of a rod as recited in claim 8 including the step of selecting at least two reference points in said third signal to correspond respectively to predetermined positions of said rod.

11. A method for measuring the position of a rod as recited in claim 8 further including the step of displaying on a computer screen one or more waveforms corresponding to either said first signal, said second signal, or said third signal.

12. A method for measuring the position of a rod connected to a reciprocating pumping system wherein the rod extends downward into a borehole in the earth and is joined to a downhole pump which lifts fluid from within the borehole to the surface of the earth, comprising the steps of:

generating an output signal from an accelerometer mounted to said reciprocating pumping system, recording a plurality of cycles of said output signal to produce a first signal, integrating said first signal to produce a second signal which has a substantially zero average value, integrating said second signal to produce a third signal, and scaling the amplitude of said third signal such that the peak-to-peak value of said third signal corresponds to a predetermined stroke length for said rod.

* * * * *